United States Patent [19]

Sassa et al.

[11] Patent Number: 4,650,091

[45] Date of Patent: Mar. 17, 1987

[54] SLIDE-FASTENER DISCHARGING APPARATUS

[75] Inventors: Yuusei Sassa, Namerikawa; Keiichi Yoshieda, Kurobe; Kunio Miyazaki, Uozu, all of Japan

[73] Assignee: Yoshida Kogyo K. K., Tokyo, Japan

[21] Appl. No.: 784,635

[22] Filed: Oct. 4, 1985

[30] Foreign Application Priority Data

Oct. 9, 1984 [JP] Japan ..... 59-210478

[51] Int. Cl.[4] ..... B23Q 7/04

[52] U.S. Cl. ..... 221/220; 221/236; 221/258; 221/262; 414/226; 294/116; 271/85; 198/463.3

[58] Field of Search ..... 221/210, 220, 224, 236, 221/258, 262, 290, 291; 414/225, 226, 753; 29/766; 901/36; 294/116; 271/85; 198/463.3, 600

[56] References Cited

FOREIGN PATENT DOCUMENTS

| | | | |
|---|---|---|---|
| 1108783 | 1/1956 | France | 221/236 |
| 2063122 | 6/1981 | United Kingdom | 414/753 |
| 256784 | 10/1970 | U.S.S.R. | 221/290 |

*Primary Examiner*—Joseph J. Rolla
*Assistant Examiner*—David H. Bollinger
*Attorney, Agent, or Firm*—Hill, Van Santen, Steadman & Simpson

[57] ABSTRACT

An apparatus for discharging slide fasteners comprises a guide unit disposed on a horizontal longitudinal path downstream of a pair of feed rollers for receiving the slide fasteners therefrom one after another, and a gripping unit disposed in the path downstream of the guide unit for releasably gripping a leading end of the individual slide fastener received in the guide unit. The guide unit includes a stationary upper guide member and a lower guide member pivotally movable to open the bottom side of the guide unit to thereby allow the individual slide fasteners therein to fall and hence become suspended from the gripping unit.

8 Claims, 4 Drawing Figures

SLIDE-FASTENER DISCHARGING APPARATUS

BACKGROUND OF THE INVENTION

1. Field of the Invention

The present invention relates to the production of slide fasteners, and more particularly to an apparatus for discharging finished slide fasteners successively out of a slide-fastener finishing machine.

2. Description of the Prior Art

There are known various apparatus for discharging finished slide fasteners successively out of a slide-fastener finishing machine. Some of the known apparatus have a horizontal belt conveyor disposed downstream of a pair of feed rollers for supporting the successive slide fasteners therefrom to convey the same away from the feed rollers, while the other known apparatus have a reciprocable gripper disposed downstream of the feed rollers for gripping a leading end of the individual slide fastener to draw the same longitudinally away from the feed rollers.

However, the conveyor-type known apparatus is disadvantageous in that the conveyor occupies a relatively large area in the apparatus, thus making the latter increased in size. A problem with the gripper-type known apparatus is that the stroke of the gripper must be long enough to draw the individual slide fastener to its full extent and hence must be commensurate with the different lengths of the slide fasteners, thus also increasing the entire length of the apparatus. Further, the known apparatus of the latter type are complex in construction and hence expensive to manufacture because the rate of movement of the gripper must be synchronous with the feeding speed of the feed rollers.

SUMMARY OF THE INVENTION

According to the present invention, an apparatus for discharging slide fasteners comprises a guide unit disposed on a horizontal longitudinal path downstream of a pair of feed rollers for receiving the slide fasteners therefrom one after another, and a gripping unit disposed on the path downstream of the guide unit for releasably gripping a leading end of the individual slide fastener received in the guide unit. The guide unit includes a stationary upper guide member and a lower guide member pivotally movable to open the bottom side of the guide unit to thereby allow the individual slide fastener therein to fall and hence become suspended from the gripping unit.

It is therefore an object of the present invention to provide a slide-fastener discharging apparatus in which each slide fastener is discharged in suspended condition, thus not only making the individual slide fasteners free from objectionable curling or other deformation, but also making the apparatus compact in size.

Many other advantages, features and additional objects will become manifest to those versed in the art upon making reference to the detailed description and the accompanying drawings in which a preferred embodiment incorporating the principles of the present invention is shown by way of illustrative example.

DETAILED DESCRIPTION

Figure 1:
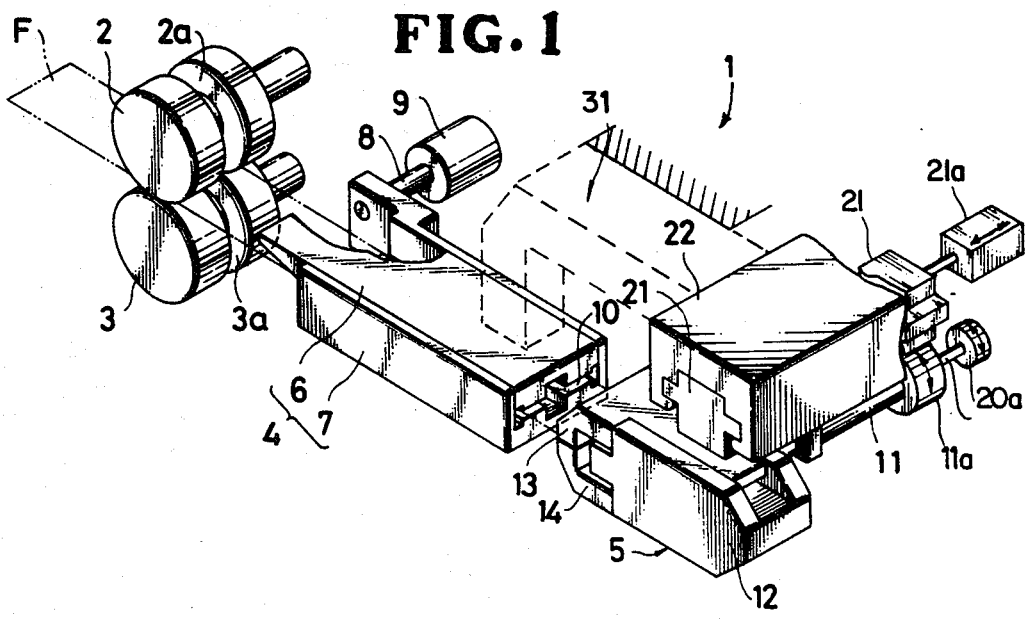
FIG. 1 is a fragmentary perspective view of a slide-fastener discharging apparatus embodying the present invention.

FIGS. 1 through 4 show an apparatus 1 for discharging finished slide fasteners F successively out of a slide-fastener finishing machine.

The apparatus 1 generally comprises a pair of feed rollers 2, 3 for feeding the slide fasteners F one after another along a horizontal longitudinal path, a guide unit 4 disposed in the path downstream of the feed rollers 2, 3 for receiving the individual slide fastener F therefrom and for guiding the same slide fastener F through the guide unit 4, and a gripping unit 5 disposed in the path downstream of the guide unit 4 for gripping a leading end of the individual slide fastener F received through the guide unit 4.

Each of the feed rollers 2, 3 has a central endless groove *2a*, *3a* extending in and around its peripheral surface so that upper and lower portions of a coupling element row of the individual slide fastener F are received in the grooves *2a*, *3a*, respectively, while the individual slide fastener F is being fed by the feed rollers 2, 3. These grooves *2a*, *3a* serve to prevent the individual slide fastener F from lateral displacement during feeding.

The guide unit 4 includes a stationary horizontal upper guide member 6 fixedly secured to a schematially-illustrated frame 31 and a lower guide member 7 secured at its upstream end to a horizontal first shaft 8 which is driven by a first drive 9 for turning through a predetermined angle. The lower guide 7 is thus pivotally movable about its upstream end with respect to the upper guide member 6 between a closed or horizontal position (FIGS. 1 and 2) in which the upper and lower guide members 6, 7 jointly define a longitudinal guide channel 10 for receiving the individual slide fastener F in the path, and an open or inclined position (FIGS. 3 and 4) in which the lower guide member 7 lies at an angle to the upper guide member 6 to open the bottom side of the guide unit 4 for allowing the individual slide fastener F to fall and hence become suspended from the gripping unit 5.

The gripping unit 5 is mounted on one end of a horizontal second shaft 11 in the form of a tube of circular cross section which is connected at the other end to a second drive *11a* for turning through an angle of 90°. Thus the gripping unit 5 is pivotally movable about the second shaft 11 between a horizontal position (FIGS. 1, 2 and 3) in which the gripping end of the gripping unit 5 faces the downstream end of the guide unit 4 and a vertical position (FIG. 4) in which the gripping end of the gripping unit 5 faces downwardly.

Figure 2:
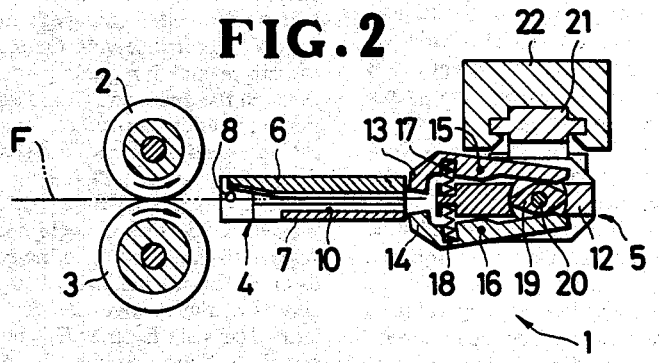
FIGS. 2, 3 and 4 are longitudinal cross-sectional views of the apparatus, illustrating the manner in which each slide fastener is discharged.
Figure 3:
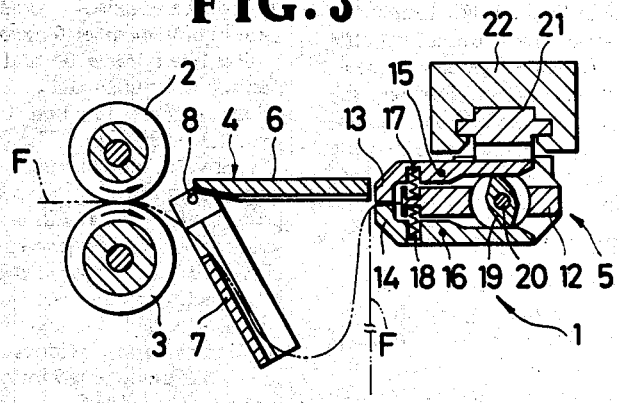
Figure 4:
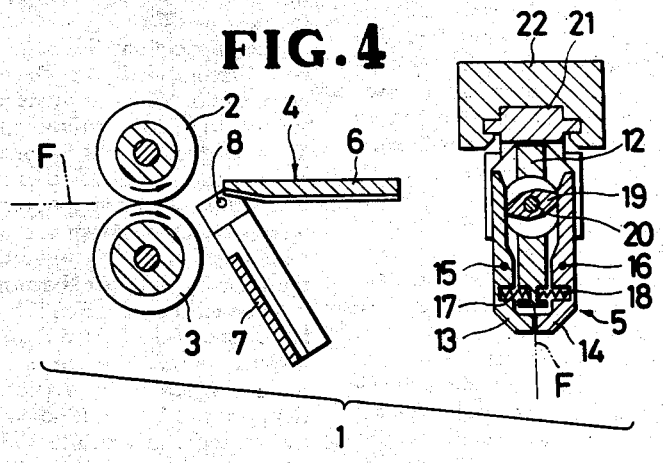

As better shown in FIGS. 2, 3 and 4, the gripping unit 5 includes a base 12, and a pair of grip members 13, 14 pivotally mounted on the base 12 by means of a pair of horizontal pins 15, 16, respectively. A pair of compression springs 17, 18 is disposed between the base 12 and the respective grip members 13, 14 to normally open the latter. A cam plate 19 is disposed between the grip members 13, 14 in sliding contact therewith and is mounted on one end of a horizontal third shaft 20. The third shaft 20 extends through the tubular second shaft 11 concentrically therewith and is connected at the other end to a third drive *20a* for turning through a predetermined angle. In response to this turning, the cam plate 19 is angularly movable relative to the base 12 about the third shaft 20 to cause the grip members 17, 18 to open and close as described below.

The base 12 of the gripping unit 5 is pivotally mounted on one end of a slide 21 which is slidably supported by a horizontal elongate support 22 fixedly secured to the frame 31 and extending perpendicularly to the path of the slide fastener F. A fourth drive **21*a* is connected to the other end of the slide 21 for reciprocatingly moving the latter and hence the gripping unit 5 longitudinally along the support 22 between a first position (FIGS. 1–4) in which the gripping unit 5 is disposed adjacent to the guide unit 4 and a second position (not shown) in which the gripping unit 5 is spaced horizontally remotely from the guide unit 4** perpendicularly to the slide-fastener path for delivery of the respective slide fastener F to a peripheral station where examination of the successive finished slide fasteners F takes place.

In operation, a freshly finished slide fastener F is fed by the feed rollers 2, 3 through the guide channel 10 of the guide unit 4 while the lower guide member 7 lies in a horizontal or closed position, as shown in FIG. 2. During that time, the gripping unit 5 is disposed in horizontal position with the grip members 13, 14 open. When a leading end of the slide fastener F arrives between the open grip members 13, 14, a detector such as a photoelectric transducer (not shown) produces an electrical signal to energize the third drive **20*a* to turn the third shaft 20 and hence the cam plate 19 through a predetermined angle, thus closing the grip members 13, 14 to grip the leading end of the slide fastener F, as shown in FIGS. 1 and 2**.

In response to this gripping, the first shaft 8 is turned clockwise through a predetermined angle by the first drive 9, thus causing the lower guide member 7 to pivotally move about the first shaft 8 from its horizontal or closed position (FIGS. 1 and 2) to its inclined or open position (FIGS. 3 and 4). In this condition, the slide fastener F, as released from the feed rollers 2, 3, is allowed to fall and hence become suspended from the gripping members 13, 14, as shown in FIG. 3.

Subsequently, the second shaft 11 is turned counterclockwise through an angle of 90° by the second drive **11*a* to pivotally move the gripping unit 5 about the second shaft 11 from its horizontal position (FIGS. 1–3) to its vertical position (FIG. 4). At that time the third shaft 20 is turned together with the second shaft 11 to keep the grip members 13, 14** closed.

Finally, the slide 21 is slidingly moved by the **21*a* drive longitudinally along the support 22 to move the gripping unit 5 in vertical position from a first position in which the gripping unit 5 is disposed adjacent to the guide unit 4 and a second position in which the gripping unit 5 is spaced horizontally remotely from the guide unit 4 and in which the grip members 13, 14 are opened to release the slide fastener F for delivery to a peripheral station where examination of the successive slide fastener F may take place. Then the lower guide member 7 is returned to its horizontal or closed position (FIGS. 1 and 2) to receive the next finished slide fastener F from the feed rollers 2, 3, for a subsequent cycle of discharging operation. In the meantime, the gripping unit 5 is also returned to its horizontal position (FIGS. 1 and 2**) to grip a leading end of this next slide fastener F.

Although various minor modifications may be suggested by those versed in the art, it should be understood that we with to embody within the scope of the patent warranted hereon, all such embodiments as reasonably and properly come within the scope of our contribution to the art.

What is claimed is:

1. An apparatus for discharging slide fasteners, comprising:

(a) a pair of feed rollers for feeding the slide fasteners successively along a horizontal longitudinal path;

(b) a guide unit disposed in said path downstream of said feed rollers for receiving the individual slide fastener therefrom and for guiding the same slide fastener through said guide unit, said guide unit including a stationary horizontal upper guide member and a lower guide member pivotally movable about its upstream end with respect to said upper guide member between a closed position in which said lower guide member lies horizontally so as to define with said upper guide member a longitudinal guide channel for receiving the individual slide fastener on the path, and an open position in which said lower guide member lies at an angle to said upper guide member so as to open a bottom side of said guide unit for allowing the individual slide fastener therein to fall;

(c) a gripping unit disposed in said path downstream of said guide unit for releasably gripping a leading end of the individual slide fastener; and (d) first drive means for pivotally moving said lower guide member from said closed position to said open position in response to gripping of the individual slide fastener by said gripping unit, thereby allowing the same slide fastener to become suspended from said gripping unit.

2. An apparatus according to claim 1, said first drive means comprising a horizontal first shaft secured at one end to the upstream end of said lower guide member, and a first drive connected to the other end of said first shaft for turning the latter through a predetermined angle.

3. An apparatus according to claim 1, further comprising second drive means for pivotally moving said gripping unit between a horizontal position in which a gripping end of said gripping unit faces the downstream end of said guide unit for receiving the individual slide fastener therefrom and a vertical position in which the gripping end of said gripping unit faces downwardly.

4. An apparatus according to claim 3, said second drive means including a horizontal second shaft secured at one end to said gripping unit and a second drive connected to the other end of said second shaft for turning the latter through an angle of 90°.

5. An apparatus according to claim 4, said gripping unit including a base, a pair of grip members pivotally mounted on said base, a pair of springs acting between said base and said grip members to normally open the latter, and means for closing said grip members against the bias of said springs.

6. An apparatus according to claim 5, said closing means including a cam plate disposed between said grip members in sliding contact therewith, a horizontal third shaft secured at one end to said cam plate, and third drive means connected to the other end of said third shaft for turning the latter through a predetermined angle.

7. An apparatus according to claim 6, said second shaft being in the form of a tube having a circular cross section, said third shaft extending through said tube concentrically therewith.

8. An apparatus according to claim 1, further comprising a horizontal elongate support extending perpendicularly to said path, a slide carrying at one end said gripping unit and slidably supported by said support, and fourth drive means connected to the other end of said slide for reciprocatingly moving the latter and hence said gripping unit longitudinally along said support.

* * * * *